United States Patent [19]

Saprokhin et al.

[11] Patent Number: 4,511,440

[45] Date of Patent: Apr. 16, 1985

[54] PROCESS FOR THE ELECTROLYTIC PRODUCTION OF FLUORINE AND NOVEL CELL THEREFOR

[75] Inventors: Alexander M. Saprokhin, Amherst; David J. Friedland, Snyder; Richard M. Baran, Cheektowaga; Jung T. Kim, Williamsville; Lynn E. McCurry, Hamburg, all of N.Y.

[73] Assignee: Allied Corporation, Morris Township, Morris County, N.J.

[21] Appl. No.: 564,639

[22] Filed: Dec. 27, 1983

[51] Int. Cl.[3] ..... C25B 1/02; C25B 1/24; C25B 11/03; C25B 11/12

[52] U.S. Cl. ..... 204/60; 204/129; 204/241; 204/247; 204/266; 204/284; 204/294

[58] Field of Search ..... 204/60, 266, 247, 284, 204/294, 128–129, 241

[56] References Cited

U.S. PATENT DOCUMENTS

| | | | |
|---|---|---|---|
| 2,592,144 | 8/1952 | Howell et al. | 204/60 |
| 2,684,940 | 7/1954 | Rudge et al. | 204/60 X |
| 2,693,445 | 11/1954 | Howell et al. | 204/60 |
| 2,996,446 | 8/1961 | Davies et al. | 204/60 X |
| 3,773,644 | 11/1973 | Tricoli et al. | 204/252 |
| 4,139,447 | 2/1979 | Faron et al. | 204/239 |
| 4,312,718 | 6/1980 | Watanabe et al. | 204/60 |

FOREIGN PATENT DOCUMENTS

| | | | |
|---|---|---|---|
| 46-20808 | 6/1971 | Japan | 204/284 |
| 200584 | 12/1982 | Japan | 204/294 |
| 668465 | 3/1952 | United Kingdom | 204/247 |
| 852369 | 10/1960 | United Kingdom . | |

*Primary Examiner*—Donald R. Valentine

*Attorney, Agent, or Firm*—Arthur J. Plantamura; Jay P. Friedenson; Richard C. Stewart, II

[57] ABSTRACT

A cell and process is provided for the production of fluorine comprising electrolyzing a liquid mixture of fluorides of alkali metal, ammonium and hydrogen fluoride. The cell anode comprises a stock of anode plates with internal passages or it may comprise a carbon shape provided with grooves and passages and fitted to a central conductor which conducts current from the exterior of the cell to the carbon anode plates within the cell. The anode having a substantially expanded working surface has the capability of removing fluorine internally. A louvered cathode permits most of the hydrogen to be vented away from the zone between the electrodes through which current passes thus reducing the ohmic voltage loss. The cathode, rather than being louvered, can be expanded metal or punched sheet or gauze. The anode, cathode and barrier may be cylindrical in form although other shapes, for instance rectangular or square in cross section or even of hexagonal section, may be used if desired. Combination of the segmented anode design with a louvered cathode provides a unique cell for fluorine production because virtually the same electrolysis condition exists at any part of the anode and cathode.

5 Claims, 16 Drawing Figures

PROCESS FOR THE ELECTROLYTIC PRODUCTION OF FLUORINE AND NOVEL CELL THEREFOR

DESCRIPTION

The present invention relates to improvements in electrolytic cells and processes for the electrolytic production of fluorine which functions with relatively greater economy and efficiency.

BACKGROUND OF THE INVENTION

The manufacture of fluorine by electrolysis of mixtures of fluorides is well known, the fluorine being derived, for example, from mixtures of an alkali metal fluoride and hydrogen fluorides. Systems of this kind are disclosed for example in U.S. Pat. Nos. 3,773,644 and 4,139,447 and in British Pat. No. 852,369. It is also known in such processes to use cells having anodes of carbon or graphite, the cathode being of mild steel or other metal resistant to the action of the electrolyte. Hydrogen is evolved at the cathode and fluorine, with perhaps varying amounts of oxygen and other impurities, at the anode. Also as mixtures of hydrogen and fluorine give rise to violent explosions, such fluorine cells customarily have a diaphragm or partition, also referred to as a "skirt" designed to prevent mixing of the gases evolved at the two electrodes. In some cells this diaphragm or partition extends downward in the interelectrode space for a distance equal to or even greater than that of the downward extension of the electrodes. In other fluorine cells, for example, and as disclosed in British Pat. No. 852,369, a barrier, impervious to gases, extends downwards for a short distance only into the interelectrode space.

It is recognized in prior art systems that the greater the spacing between the electrodes, the greater must be the potential applied and the energy consumed to electrolyze a given amount of material. Therefore it is desirable to diminish the interelectrode space as far as is commensurate with safety. Nevertheless, in general (except in certain cells with porous or gas permeable carbon anodes) it has not been possible in the prior art to safely diminish the distance between anode and cathode (hereinafter termed the electrode separation) or the distance between anode and gas barrier (hereinafter termed the anode gap) below certain limiting values. As stated in British Pat. No. 852,369, for instance, as the electrodes extend further downward into the electrolyte below the bottom of the gas barrier, the interelectrode spacing must be increased. A minimum is prescribed for safe working such that when the electrodes extend to 8 inches below the gas barrier, the electrode separation should not be less than $2\frac{5}{8}$ inches (6.65 cm) nor the anode gap less than 1 inch (2.54 cm). The corresponding values when the electrodes are extended to 36 inches (91 cm) below the barrer are $4\frac{3}{4}$ inches (12 cm) and 1 11/16 inches (4.3 cm). However, if a special louvered cathode is used, the figures for the electrode separations appropriate to these depths of 8 inches (20.3 cm) and 36 inches (91 cm) may be diminished to $2\frac{1}{4}$ inches (5.7 cm) and 3 15/16 inches (10 cm), respectively. However, as noted in said British Patent, these are prescribed as limiting minimum values if anodic current density does not exceed 0.15 Å/cm$^2$.

By use of the anode of the invention, in which passages for the flow of gases are provided, high current densities are possible. Such current densities are even higher than those disclosed as "critical current densities" in U.S. Pat. No. 4,312,718.

Current density is determined with reference to that portion of the anode surface which is directly opposite to the cathode.

A number of reasons exist for the inefficiency of prior art electrolytic cells for fluorine production. One reason, for example, is the low productivity which is due to low anodic current density and comparatively small anode length and/or an undesirably large distance between the anode and cathode. Also, because of low anodic current density, these prior art cells necessitate high equipment cost and high capital cost outlays.

It is thus apparent that a need exists for an improved cell configuration which enhances the economy as well as the efficiency of systems for the electrolytic production of fluorine.

SUMMARY OF THE INVENTION

In accordance with the invention a novel cell for the production of fluorine is provided. The production of fluorine by the electrolysis of a liquid mixture of hydrogen fluoride and alkali and/or ammonium fluorides may be carried out at high current densities in a cell having a small anode-cathode gap and a greatly increased anode and cathode length and functions without the evolution of fluorine as free bubbles at the vertical carbon surface of the anode assembly facing the cathode and without formation of explosive mixtures of hydrogen and fluorine.

The process for the production of fluorine according to the present invention comprises electrolyzing a liquid mixture of at least one of the fluorides of the alkali metal and/or ammonium fluorides and hydrogen fluoride. At a temperature of the order of 80°–110° C. one can employ a fused substantially dry mixture of potassium fluoride and hydrogen fluoride having a composition approximating substantially to KF, 1.8 HF to KF, 2.2 HF. The invention uses a segmented anode in conjunction with a gas impermeable barrier which entirely surrounds the upper part of the anode assembly. Alternatively an anode comprising a carbon block with grooves therein which in effect simulate a segmented anode may be employed. Such arrangements are used in conjunction with a louvered cathode.

The object of the present invention is to provide a process of the aforesaid kind and apparatus therefor which will permit a cell of the aforesaid kind to run at significantly higher loads thus to obtain a larger output of fluorine per unit of plant and furthermore maintain the same or even lower cell voltage.

The segmented anode assembly comprises a stack of carbon anode plates fitted to a central conductor which serves to conduct current from the exterior of the cell to the carbon anode plates within the cell. Preferably the carbon has a porosity of less than 25 percent. To prevent corrosion of the metal conductor of the upper part of the anode assembly and conductor between carbon plates, magnesium tubes and rings are employed to protect these areas.

Due to the nonwetting surface of the carbon during normal electrolysis, the fluorine creeps up the vertical electrode surface, travels around the shoulder of the carbon plate and exits through the internal fluorine passage holes. Unlike chlorine which forms bubbles that break off of carbon electrodes as they are formed, fluorine clings to the surface of, and moves up at the surface of, the electrode. This decreases the thickness of the fluorine layer on the carbon surface since fluorine will exit internally and not over the electroactive surface area. No large accumulation of fluorine on any plate occurs since each anode plate will have its own exit for fluorine gas. Each anode plate will only be masked by fluorine produced by that plate and not by fluorine from other anode plates below it. As a result the voltage drop due to a fluorine layer on the anode will be lower than for conventionally arranged vertical anodes. Because of this novel design, the working surface of the anode assembly comprises not only the surface facing the cathode but also the top and the bottom of each plate, inside the holes that form the internal fluorine passages and inside the grooves between anodes.

The anode of stacked carbon plates is used in conjunction with a louvered cathode which permits most of the hydrogen to be vented away from the zone between the electrodes. This significantly reduces the quantity of hydrogen bubbles in the electrolyte through which current passes between the electrodes reducing the ohmic voltage loss. Said cathode, rather than being louvered, can be expanded metal or one which consists of punched sheet or gauze. If a plain sheet cathode is used, it will be necessary to increase anode-cathode separation. Clearly if this separation is inadequate, then when high current density is employed, there is a possibility of a particularly brisk evolution of hydrogen leading to crowding of hydrogen bubbles within this space, thus increasing the danger of hydrogen finding its way into the anode compartment. The anode, cathode and barrier may be cylindrical in form although any other suitable shape, for instance those having cross sections that are rectangular, square, triangular, hexagonal, octagonal, and the like, may be used if desired.

DESCRIPTION OF THE PREFERRED EMBODIMENTS

According to the present invention a process for the production of fluorine comprises electrolyzing a liquid mixture of at least one of the fluorides of the alkali metal and/or ammonium fluorides and/or hydrogen fluorine.

Figure 1:
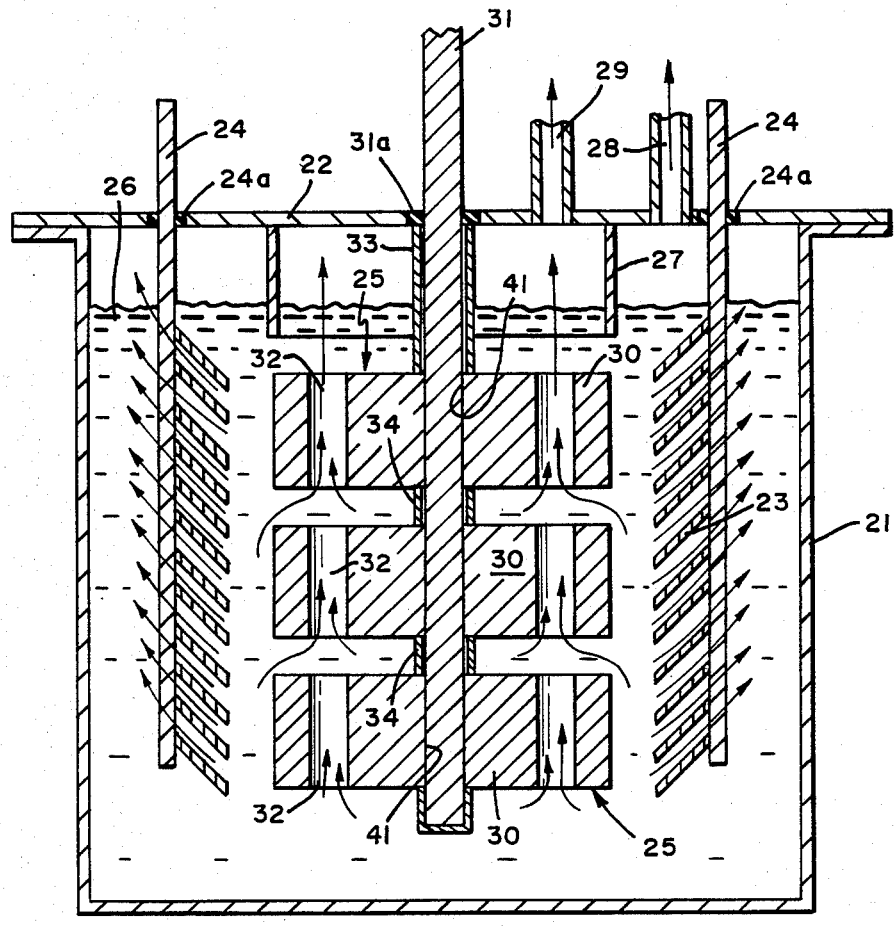
FIG. 1 is a cross-sectional elevation view of the fluorine cell made according to the invention.

A cell suitable for carrying out the invention is shown in FIG. 1, not drawn to scale. Referring to the drawing, 21 is a container of mild steel or other suitable resistant metal, provided with a lid 22, and 23 is a louvered cathode which may be of mild steel, copper or other material substantially resistant to the electrolyte and products of electrolysis. The cathode is supported by an electrolytically conducting cylinder-like member 24 which is insulated (at 24*a*) from the cell lid through which it passes. Surrounding the upper portion of the anode assembly 25 and which dips into the electrolyte 26 is a skirt or barrier 27. The pipes 28 and 29 serve for hydrogen and fluorine removal, respectively.

The anode assembly 25 in this design could be a stack of circular carbon anode plates 30 fitted to a central conductor 31 which serves to conduct current from the exterior of the cell to the carbon anode plates 30 within the cell. It is a solid metal rod or pipe, of copper or other suitable metal insulated at 31*a*. To prevent corrosion of the copper conductor 31 of the upper part of the anode assembly and copper conductor between plates, a magnesium tube 33 and magnesium rings 34 protect these areas. Magnesium passivates at an anodic potential. Other suitable resistant materials may be used for this purpose.

Figure 2:
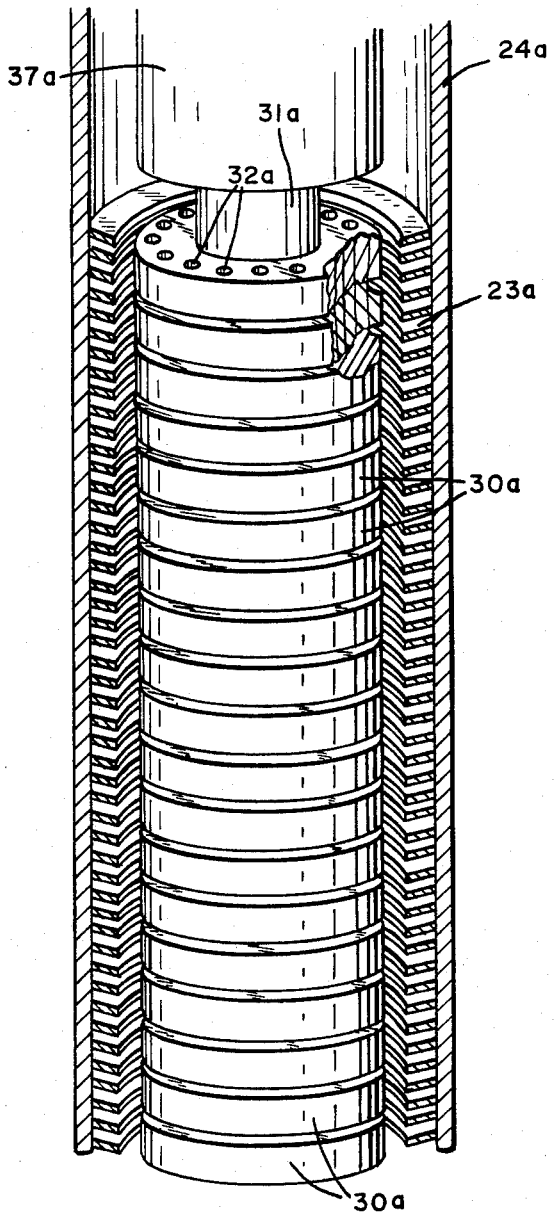
FIG. 2 illustrates partly in section the anode assembly with louvered cathode.

The embodiment illustrated in FIG. 2 depicts a full-scale solid carbon anode assembly comprising a plurality of carbon plates 30*a* cut from a solid carbon block with passages 32*a* which serve as internal fluorine passages. The cathode comprises the louvered structure shown at 23*a* provided with the louvered cathode electrical contact 24*a*. Visible at the top of the anode 30*a* are the fluorine gas passages 32*a*. The anode is electrically connected through the conductor 31*a*. A shirt or barrier 27*a* which collects the fluorine gas is suitably positioned to confine the fluorine gas rising through passages 32*a*.

Figure 3A:
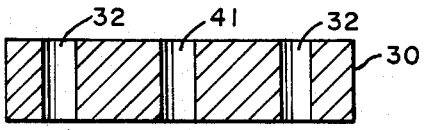
FIG. 3*a* is a cross-section taken along line 3*a*—3*a* of FIG. 3.
Figure 3:
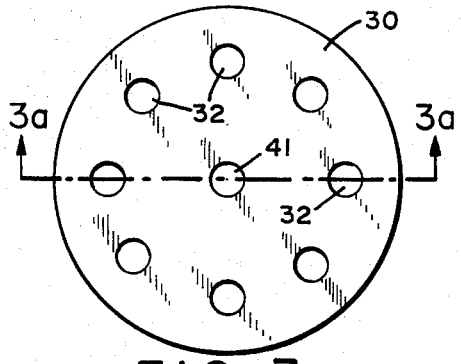
FIG. 3 is top view of one of the anode blades showing internal passages.

Each carbon anode plate is of circular cross-section with a central hole for the conductor and other holes 32 which serve as internal fluorine passages. A side and a top view of a single carbon anode plate 30 is shown in FIGS. 3*a* and 3, respectively. The conductor 31 is inserted in the central hole 41, while fluorine gas escapes through holes 32 which serve as internal fluorine passages.

Figure 4A:
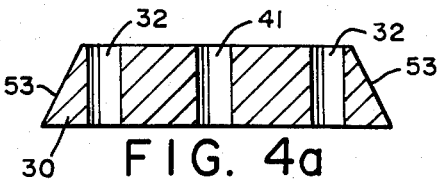
FIG. 4*a* is a cross-sectional view taken along line 4*a*—4*a* of FIG. 4.
Figure 4:
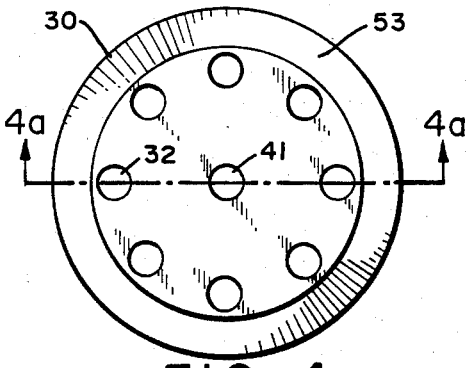
FIG. 4 is top view of an alternate anode blade showing a beveled periphery and showing, as well, an internal passage.
Figure 5A:
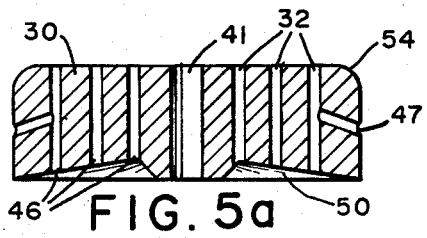
FIG. 5*a* is a cross-sectional view taken along line 5*a*—5*a* of FIG. 5.
Figure 6A:
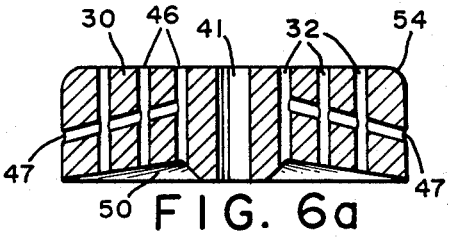
FIG. 6*a* is a cross-sectional view taken along line 6*a*—6*a* of FIG. 6.
Figure 5:
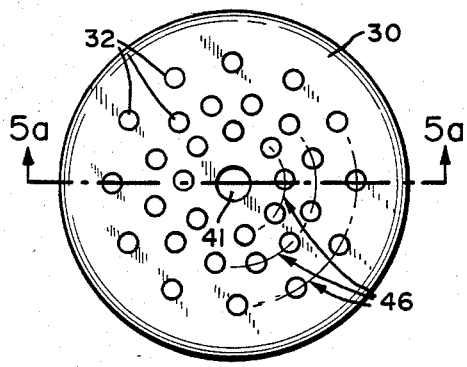
FIG. 5 is top view of another embodiment showing a blade with a larger number of passages at various distances from the working surface of the anode and showing, as well, a transverse passage for removal of fluorine from the anode surface.
Figure 6:
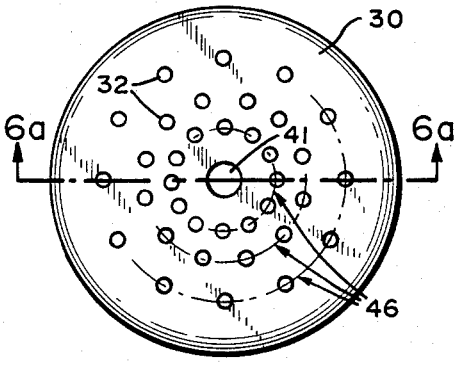
FIG. 6 is top view of still another anode blade showing extended transverse passages.

The edge 53 of the carbon plate can be beveled so that it slopes away from the cathode (FIGS. 4 and 4*a*) or the top edge 54 of the anode can be tapered or rounded (FIGS. 5 and 5*a*). The bottom part 50 of a plate 30 can be made so that it will direct fluorine evolved on the bottom of the anode centrally toward the internal fluorine passages 32 as shown in FIGS. (5*a*) and (6*a*). The carbon plate 30 may have one or several rows 46 of internal fluorine passages 32. The anode 30 may also have a groove 47 which cuts the anode into two or more blades. Thus, groove 47 connects the anode surface to the internal fluorine passages 32 (see FIGS. 5*a* and 6*a*).

Due to the nonwetting surface of the carbon during normal electrolysis, fluorine creeps up the vertical electrode surface, travels around the shoulder of the carbon plate and exits through the internal fluorine passages 32 of the blade above it. This decreases the thickness of the fluorine layer on the carbon surface of the anode, since fluorine will exit internally and not over the electroactive surface area. Each anode plate will primarily only be masked by fluorine produced by that plate and not by fluorine rising from other anode plates below it. As a result the voltage drop due to a fluorine layer on the anode will be lower than for conventionally arranged vertical anodes.

Figure 11:
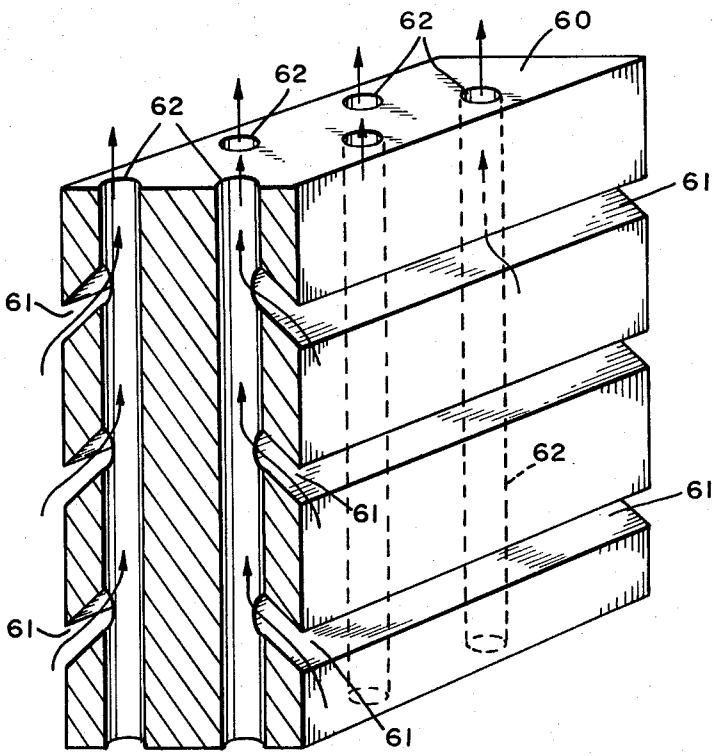
FIG. 11 is an alternate anode showing the design of the invention applied to a rectangular anode geometry.

Due to this design, the working surface of the anode assembly is several times larger than the vertical surface area of a cylindrical anode facing the cathode since the fluorine evolution will not only occur on the surface facing the cathode but also on the top and the bottom of each plate as well as inside the holes that form the internal fluorine passages. An arrangement of the kind provided by the present invention permits operation at higher anodic current densities than conventional systems because the anodic system of the invention removes fluorine as it is formed from the anodic surface. The basic idea of an anode which has the capability to remove fluorine internally and has a much greater working surface than a conventional anode can be implemented in another way as shown in FIG. 11. The anode, rather than being composed of separate plates, can be a solid rectangular block 60 with surface grooves 61, to direct fluorine into the interior of the anode. From these grooves 61 which effectively segment the anode, fluorine can exit through longitudinally drilled holes 62 which serve as internal fluorine passage. The electrical contact arrangement is not shown. This anode design has the same advantages as the anode design described with reference to FIG. 1.

A louvered cathode will permit most of the hydrogen to be vented away from the zone between the electrodes. This will significantly reduce the quantity of hydrogen bubbles in the electrolyte through which current passes between the electrodes reducing the ohmic voltage loss. Said cathode, rather than being louvered, can be expanded metal or one which consists of punched sheet or gauze. If a plain sheet cathode is used, it may be necessary to increase anode-cathode separation. Clearly if this separation is inadequate, then when high current density is employed, there is a possibility of brisk evolution of hydrogen leading to crowding of hydrogen bubbles within this space, thus increasing the danger of hydrogen finding its way into the anode compartment. The anode, cathode and barrier may be cylindrical in form although other geometrics shapes, for instance, of rectangular or square section or even of hexagonal section may be used if desired. Various metals may be employed in fabricating the cathode. Thus, for example, in addition to mild steel, nickel or copper or their alloys, such as monel, and the like, may be used.

The combination of the segmented anode design with a gas directing louvered or expanded metal cathode will create a unique cell for fluorine production because it is expected that virtually the same electrolysis condition will exist at any part of the anode and cathode. It will be possible to increase the anode and cathode length several times and significantly reduce the anode-cathode distance, for example, to 5 mm. At the same time it will be possible to operate cell with very high surface anodic current density, for example 1.2 A/cm$^2$, while maintaining a low operating cell voltage without formation of an explosive mixture of hydrogen and fluorine and having a current efficiency of better than 90%.

It will be apparent that various forms of carbon can be used in fabricating the carbon anode of the invention such as isotropic, anisotropic, dense, porous (or gas permeably). It should be noted, however, that while the advantages of porous or gas permeable carbon are described in many of the patents included such anodes possess also many disadvantages—such as poor lifetime, high cost, burning by fluorine, extreme difficulty in making an effective anode-conductor contact. The cell design of the present invention has the advantages of porous carbon-internal venting of fluorine gas, high surface area—but does not have the disadvantages associated with porous carbon since one can use dense carbon with this design. Also, dense carbon is easier to attach to a conductor, has a long lifetime and is less expensive.

It will be understood that various other configurations of anode-contact other than a central conductor may be employed. As such, for example are multiple conductors, non-centered, exterior conductor, and the like.

A feature at the anode design of the invention resides in the fact that the design decreases the thickness of the fluorine layer on the anode which makes possible lower cell voltage. Since fluorine exits the anode internally it does not break away from the anode frequently as free bubbles. Hence the interelectrode gap can be decreased in length further lowering the cell voltage and energy cost.

A further advantage resides in the fact that since a similar electrolysis condition exists at each anode blade or segment, anode height is no longer a restriction as it is in a conventional cell. Thus greater production can be achieved with less floor space in a plant.

The invention will be further described by reference to the following specific example. It is to be understood, however, that although details are provided herein, these are given primarily for purposes of illustration and the invention in its broader aspects is not restricted thereto.

EXAMPLE I

Figure 10:
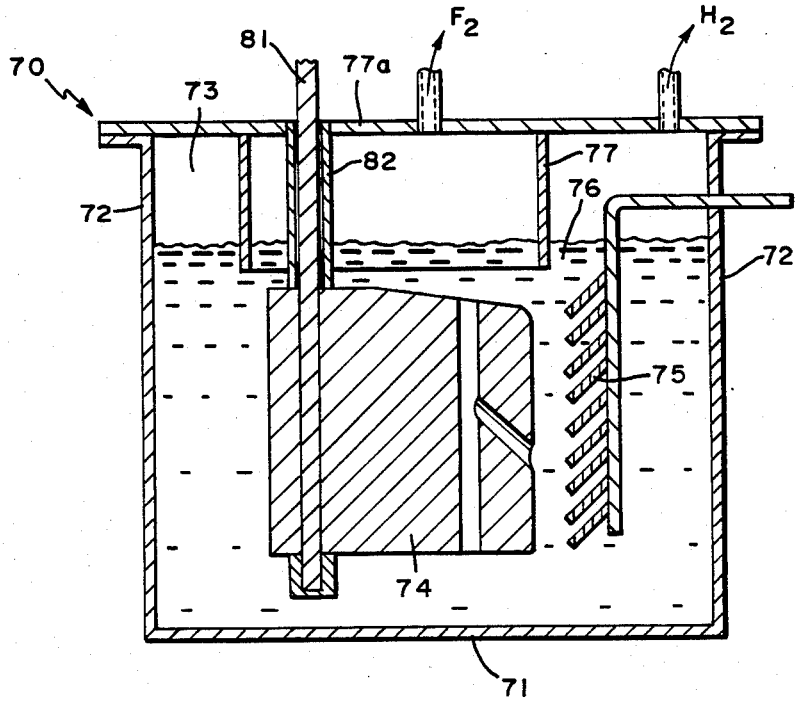
FIG. 10 illustrates in cross-section the test cell using the anode segment of FIG. 9.

The cell used in this example and shown in FIG. 10 reproduces in effect a cross-section of the upper portion of the full size cell described above with reference to FIG. 1. The cell body is fabricated of two different materials. The bottom 71 of the cell 70 and the two walls 72 are mild steel. The remaining two side walls, i.e., the face and back of the cell are made of polymethylpentene, a transparent plastic resistant to KF. 2 HF, to permit observation of gas and melt circulation within the cell. The cell is fitted with an anode 74, and mild steel louvered cathode 75. Surrounding the upper part of the anode assembly and which dips into electrolyte 76 is a skirt or barrier 77. The skirt 77, as well as, the top or lid 77*a* of the cell 70 is formed of a suitable metal which is resistant to fluorine such a magnesium, monel metal and the like. Clearance between these parts and the cell plastic walls is kept to a minimum in order to prevent current paths to the side and back of the anode, and to prevent melt circulation past the edges of the electrodes. Thus, current distribution and mass transport will be similar to that in the larger cell of this design. Distance between the anode and the leading edge of the cathode is 5 mm.

Figure 7:
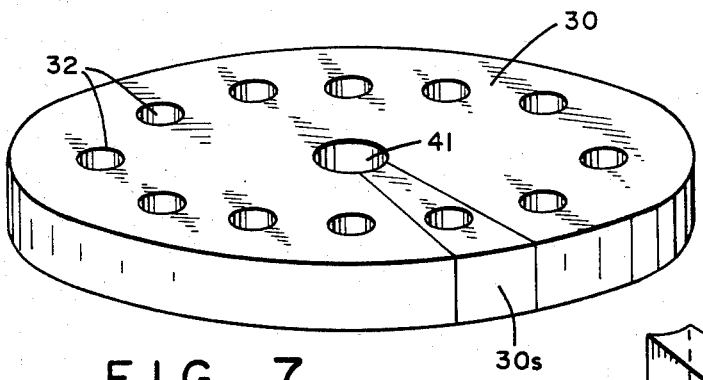
FIG. 7 illustrates for test purposes the taking of a slice of a blade.
Figure 7A:
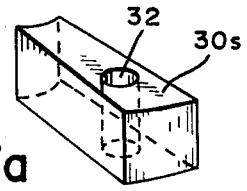
FIG. 7*a* is a perspective view of a segment taken from the slice of FIG. 7.

Referring to FIGS. 7 and 7*a* the anode 74 represents a part, i.e. a slice, of a full scale carbon plate. The full scale carbon plate was cut so that the carbon part of the laboratory anode assembly represents a slice (FIG. 7*a*) of the full scale carbon plate shown in FIG. 7. Three sides of the carbon laboratory anode which would be located inside the full scale carbon plate are covered with a U-shape magnesium plate to prevent electrolysis on these areas, which means that the working surface area will be the anode surface facing the cathode, the uncovered top and the bottom of the anode and the area inside the groove and the internal fluorine passage.

Figure 8:
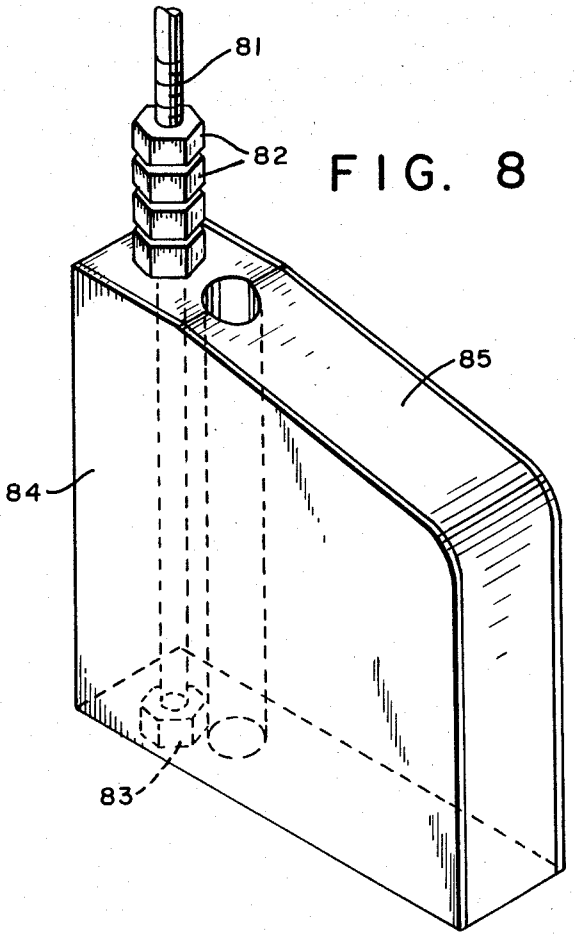
FIG. 8 illustrates the anode used in the test cell.
Figure 9:
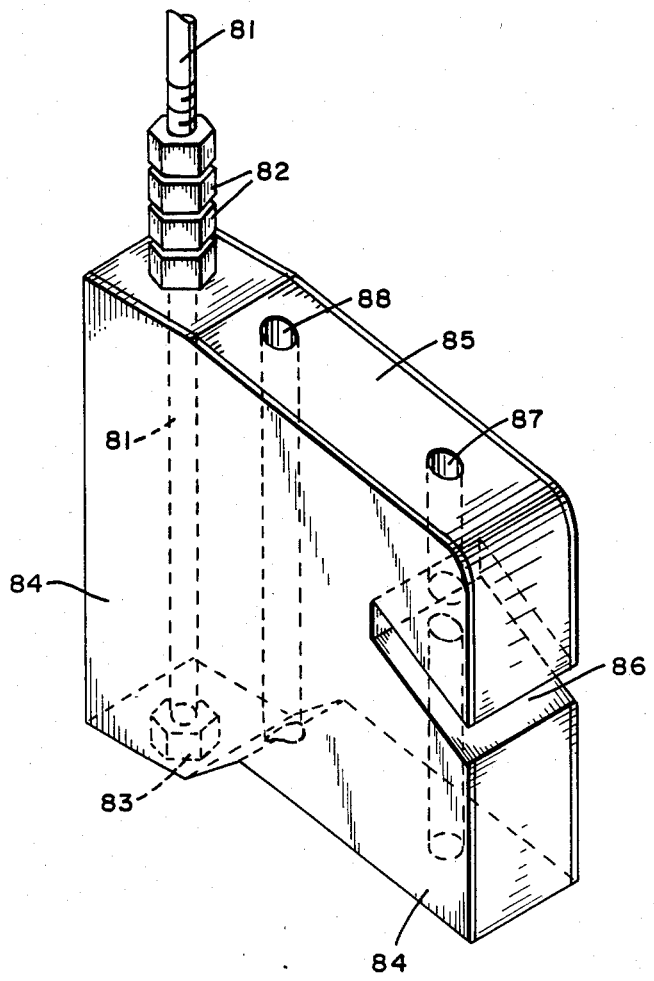
FIG. 9 illustrates an alternate anode segment which has been effectively converted into two blades by a transverse groove.

FIGS. 8 and 9 show the laboratory anode assemblies. FIG. 8 shows a test anode 84 which uses a segment of the anode which is referred to as FIG. 7*a*. Comprising the copper conductor 81 passing through the anode 85. The conductor 81 is threaded through a plurality of magnesium nuts 82 and a magnesium cap nut 83 which serve to prevent corrosion of the copper conductor 81 from the influence of electrolyte. A U-shaped magnesium shield 84 serves to prevent electrolysis on the sides and back of the anode 85. The passage 88 permits the removal therethrough of fluorine which is drawn from the bottom of the anode. Referring to FIG. 9, reference numeral 81 is a copper conductor contained within magnesium nuts 82 and magnesium capnut 83 which serve to prevent corrosion of the copper conductor, a U-shaped magnesium shield 84 serves to prevent electrolysis on the sides and the back of the anode 85. The groove 86 is cut at a 45° angle and connected to the hole 87 for internal fluorine passage. An additional hole 88 for internal fluorine passage removes fluorine from the bottom of the anode.

The following table illustrates the relationship between current density and cell voltage which is obtained with a 30 amp laboratory cell described above. Current density is determined with reference to the perceived vertical anode surface which is directly opposite the cathode. This surface is 2.5 cm wide (the same width as the carbon part of the anode assembly facing the cathode) and 10 cm in height which is supposed to represent the vertical distance between bottom edge of two neighboring carbon plates of a "full" scale anode assembly.

The operating conditions were:

1. temperature 95°–100° C.
2. electrolyte contained 40–41% HF
3. current efficiency > 90%.

During cell operation fluorine from the lower part of the anode was observed to exit through the groove into the internal fluorine passage hole. No evolution of fluorine as free bubbles at the vertical carbon surface was observed.

| Current A | Anodic Current Density A/cm$^2$ | Cell Voltage* Volts |
|---|---|---|
| 1.75 | 0.07 | 5.2–5.4 |
| 3.75 | 0.15 | 6.1–6.3 |
| 15 | 0.6 | 8–8.5 |
| 30 | 1.2 | 10–11 |

*Includes variations due to temperature and HF concentration variations.

It will be apparent that various modifications may be effected without departing from the scope of the invention. The several details disclosed as illustrative are not to be construed as placing limitations on the invention except as may be recited in the appended claims.

We claim:

1. In a process for the electrolytic production of fluorine in a cell having an anode and a cathode, the improvement which comprises providing the anode with substantially horizontal grooves connected to substantially vertical holes, said grooves and holes forming internal passages directing the flow of fluorine generated at the anode upward, away from the surface, and toward the interior of the anode employing in conjunction therewith a cathode having a louvered structure, generating fluorine gas in the cell, effecting the removal from the surface of the anode of fluorine formed on the surface of the anode by withdrawing said fluorine internally through said passages in the anode and venting hydrogen, which is formed during the generation of fluorine, from the zone between the anode and cathode through said louvered cathode.

2. An electrolytic cell for the production of fluorine comprising:

(a) a container for electrolyte;

(b) an anode comprising a segmented carbon structure having substantially horizontal grooves connected to substantially vertical holes, said grooves and holes forming internal passages that direct the flow of fluorine generated at the anode upward, away from the surface, and toward the interior of the anode;

(c) a louvered cathode with the anode for promoting the venting of hydrogen from the zone between the anode and cathode;

(d) means for maintaining an operable temperature in the cell; and (e) a partition in the cell for separating the fluorine gas generated.

3. The cell of claim 2 wherein the anode comprises a plurality of superimposed carbon plates.

4. The cell of claim 3 wherein said plates are circular.

5. The cell of claim 2 wherein said anode is a unitary carbon mass provided with internal passages for conducting fluorine formed therein.

* * * * *

UNITED STATES PATENT AND TRADEMARK OFFICE

CERTIFICATE OF CORRECTION

PATENT NO. : 4,511,440

DATED : April 16, 1985

INVENTOR(S) : A. M. Saprokhin, D. J. Friedland, R. M. Baran, J. T. Kim, and L. E. McCurry It is certified that error appears in the above-identified patent and that said Letters Patent are hereby corrected as shown below:

Front Page, Filing date, "Dec. 27, 1983" should read -- Dec. 22, 1983 --.

Signed and Sealed this

*Fifteenth* Day of *October 1985*

[SEAL]

*Attest:*

DONALD J. QUIGG

*Attesting Officer*

*Commissioner of Patents and Trademarks—Designate*